US006412593B1

(12) United States Patent
Jones

(10) Patent No.: US 6,412,593 B1
(45) Date of Patent: Jul. 2, 2002

(54) CUSHIONED EARPHONES

(75) Inventor: Owen Jones, Ipswich (GB)

(73) Assignee: NCT Group, Inc., Westport, CT (US)

( * ) Notice: Subject to any disclaimer, the term of this patent is extended or adjusted under 35 U.S.C. 154(b) by 0 days.

(21) Appl. No.: 09/646,401

(22) PCT Filed: Mar. 10, 1999

(86) PCT No.: PCT/GB99/00729

§ 371 (c)(1),
(2), (4) Date: Sep. 15, 2000

(87) PCT Pub. No.: WO99/48325

PCT Pub. Date: Sep. 23, 1999

(30) Foreign Application Priority Data

Mar. 18, 1998 (GB) ..... 9805619

(51) Int. Cl.[7] ..... H04R 25/00

(52) U.S. Cl. ..... 181/129; 181/130; 181/131; 181/134; 181/135; 2/209

(58) Field of Search ..... 181/129, 130, 181/131, 134, 135, 137; 2/209

(56) References Cited

U.S. PATENT DOCUMENTS 3,051,961 A * 9/1962 Clark ..... 2/209
3,593,341 A * 7/1971 Aiteo ..... 2/209
4,668,557 A 5/1987 Lakes ..... 428/131
4,809,811 A 3/1989 Gorike ..... 181/129
4,856,118 A 8/1989 Sapiejewski ..... 2/209
5,023,955 A * 6/1991 Murphy, II et al. ..... 2/209
5,420,381 A 5/1995 Gardner, Jr. et al. ..... 181/129

FOREIGN PATENT DOCUMENTS

WO WO 96/35744 11/1996
WO WO 97/48296 12/1997

OTHER PUBLICATIONS

Burke M, "A Stretch of the Imagination", New Scientist, vol. 154, No. 2085, Jun. 7, 1997, pp. 36–39.

Pickles A P et al, The Effect of Powder Morphology on the Processing of Auxetic Polypropylene (PP of Negative Poisson's Ratio), Polymer Engineering & Science, vol. 36, No. 5, Mar. 15, 1996, pp. 636–642.

* cited by examiner

*Primary Examiner*—Shih-Yung Hsieh
(74) *Attorney, Agent, or Firm*—R. Michelle Larson

(57) ABSTRACT

An earphone having a drive unit (22) carried by an earphone shell (20) and covered by an ear cushion (24) of auxetic foam.

23 Claims, 2 Drawing Sheets

CUSHIONED EARPHONES

BACKGROUND OF THE INVENTION

This invention relates to a cushioned earphone, and in particular to a cushioned active headset providing noise cancellation.

A conventional cushioned earphone, for example as known from U.S. Pat. No. 4,809,811, is shown in FIG. 1. of the accompanying drawings. The drive unit 10 within the earphone shell 12 is separated from the ear by means of the foam cushion 14. The cushion 14 serves two purposes.

The first is one of comfort, whereby the foam is compliant enough to partially mould around the irregularities of the ear and thereby spread the pressure of the earphone more or less evenly over the entire contact area. This avoids 'hot spots' that can lead to soreness of the ear.

The second purpose of the foam is to allow the sound from the drive unit through to the ear more or less unimpeded whilst preventing it from leaking out to the surrounding space thereby reducing the sensitivity of the headset. This leakage takes place through the body of the foam itself as well as through any gaps that occur between the foam and the ear due to imperfect sealing.

These requirements are unfortunately contradictory. The best comfort and least leakage due to poor contact is obtained if the foam is deep and of low density so that it's compliance is higher, but this allows more leakage through the foam and hence less sensitivity. Increasing the sensitivity by use of a denser foam not only reduces comfort but also forms more of a barrier between the drive unit and the ear.

There are ways to partially overcome these difficulties and one example is shown in FIG. 2 of the accompanying drawings. This approach has a cushion that is moulded with a thinner central region 14A so that there is less impediment to the sound passing from the drive unit 10 through to the eardrum, but there still remains the compromise between comfort and sensitivity in the choice of foam density.

Thus, with a conventional foam cushioned earphone, there is e acoustics of the headset when the earphone is pressed against the ear. Under these conditions the acoustics impedance of the foam increases, the leaks decrease and the volume between the drive unit and the ear canal also decreases. These factors cause the acoustic output of the earphone to increase. With a normal headset this merely causes frequency response variations (and a left/right imbalance if only one earphone is pressed against the ear), but with an active headset the results can be highly disadvantageous. With a virtual earth negative feedback type headset the rise in acoustic gain can lead to instability, whilst with a feedforward headset noise cancellation is severely degraded.

This difficulty in the choice of foam density occurs because of the inherent characteristics of conventional foams. As the material is compressed in one direction its tendency is to expand in the perpendicular directions and vice versa, maintaining more or less a constant volume. Thus if an object presses into a sheet of foam the thickness directly below the depression is reduced and therefore the region under the depression expands outwards. More importantly; however, the surface of the foam has been stretched in two dimensions over a fairly wide area in order to create the depression and the effect of this is for the thickness of the foam away from the immediate area of the depression to decrease, thus pulling the surface of the foam away from the object. In the case of a protrusion from a surface, as in the case of irregularities in the shape of an ear pressing into earphone foam, the result is to leave air gaps around the protrusion where sound can leak through. This effect is demonstrated in FIG. 3 of the accompanying drawings, wherein a typical air gap is referenced 15.

DETAILED DESCRIPTION OF THE INVENTION

According to the invention, there is provided an earphone having active noise cancellation including a sound drive unit and a deformable earpad, wherein at least part of the earpad which is compressible is made of auxetic foam.

Figure 1:
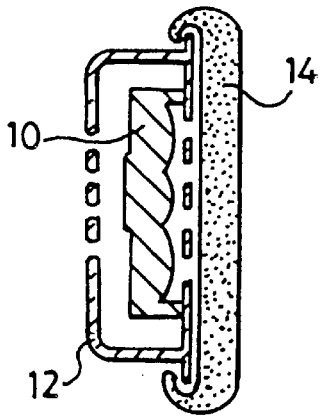
Fig. 1 PRIOR ART
FIG. 1 illustrates a conventional cushioned earpiece, in accordance with the prior art.
Figure 2:
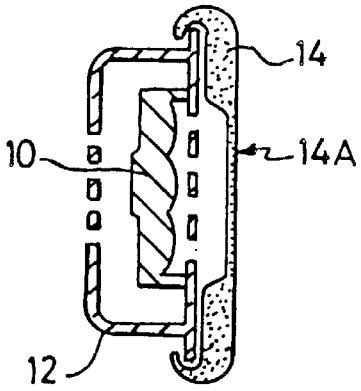
Fig. 2 PRIOR ART
FIG. 2 illustrates a cushioned earpiece, in accordance with the prior art.
Figure 3:
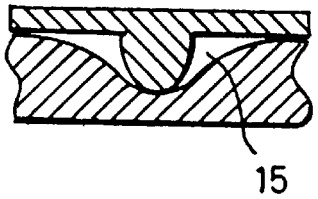
Fig. 3 PRIOR ART
FIG. 3 illustrates a typical air gap.
Figure 4A:
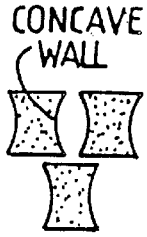
FIG. 4*a* illustrates an undeformed auxetic foam cell with concave side walls, in accordance with the present invention.
Figure 4B:
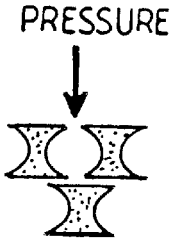
FIG. 4*b* illustrates the effect of applying pressure on the undeformed auxetic foam cell of FIG. 4*a,* in accordance with the present invention.

An auxetic foam, as used in this specification and the appended claims, means a foam material which, in contrast with conventional foam materials, has the property of contracting in directions perpendicular to an applied compression, thus reducing their overall volume. Such auxetic foams are described in "A Stretch of the Imagination" in New Scientist No. 2875, pages 36 to 39. The aforesaid property stems from the unique structure of the foam whereby the cell walls bend inwards, as shown in FIGS. 4*a* and 4*b* of the accompanying drawings. FIG. 4*a* shows an undeformed auxetic foam cell with concave side walls, and FIG. 4*b* shows the effect of applying pressure in the direction indicated. When more pressure is applied, the cell walls buckle further inwards and reduce the cell volume. An auxetic foam material is described in U.S. Pat. No. 4,668, 557.

Thus, in the earphone according to the invention, the tendency is for the auxetic foam more readily to mould around irregularities in the shape of the ear and so reduce air leaks. As the auxetic foam is compressed under a protrusion, the stretching of the surface causes the thickness of the foam away from the protrusion to increase and so push itself closer to the ear to reduce the size of any air leak. Ths cushion thus moulds itself more perfectly to the ear and increases comfort at the same time as reducing leakage.

In an ear defender, for example, the cushion is required to fit very well in order to obtain a high degree of passive attenuation. The irregularities in the shape of the head reduce the goodness of the fit and lead to poorer attenuation unless the cushion is compliant. A compliant cushion, however, is more prone to allowing sound to pass through it. The use of auxetic foam overcomes this difficulty, because the foam density can be increased without compromising the ability of the cushion to mould to the shape of the head. The auxetic foam can be used either by itself, whether or not liquid impregnated, or with a liquid or liquid-plusfoam backing layer and with a skin cover or with a skin formed onto the foam itself.

The auxetic foam can also be used in a similar manner for a supra-aural earphone cushion in which the foam is enclosed inside a skin to increase the acoustic impedance. This skin can either be formed on the foam as it is moulded or can be a separate cover into which the auxetic foam is inserted. The use of the auxetic foam will again ensure that the cushion will fit better to the ear and reduce leaks.

With a conventional foam cushioned earphone, there is a problem with the acoustics of the headset when the earphone is pressed against the ear. Under these conditions the acoustic impedance of the foam increases, the leaks decrease and the volume between the drive unit and the ear canal also decreases. These factors cause the acoustic output of the earphone to increase. With a normal headset this merely causes frequency response variations (and a left/right imbalance if only one earphone is pressed against the ear), but with an active headset the results can be catastrophic. With a virtual earth negative feedback type headset the rise in acoustic gain can lead to instability, whilst with a feedforward headset noise cancellation is severely degraded.

Moreover, as Cutbert explained, pressing the earphone against the ear can lead to catastrophic results as far as active noise cancellation is concerned, when a conventional foam is used for the earphones.

If an open-cell auxetic foam is used for the earpad then these effects can be ameliorated. As explained earlier, the cell walls of the auxetic foam bend inwards when the foam is compressed and this causes the intersperses to increase in size. If the physical properties of the foam are correctly chosen then the acoustic impedance of the foam can be made to decrease as the foam is compressed, thus reducing the acoustic gain. The foam will also contract circumferentially and thus tend to reduce the front volume, but this can be somewhat counteracted by fixing the inner circumference of the foam so that the contraction is mainly confined to the outer circumference. In this way, the increase in acoustic gain will be lower than that for conventional foam and so improve stability margins and cancellation performance.

Figure 5:
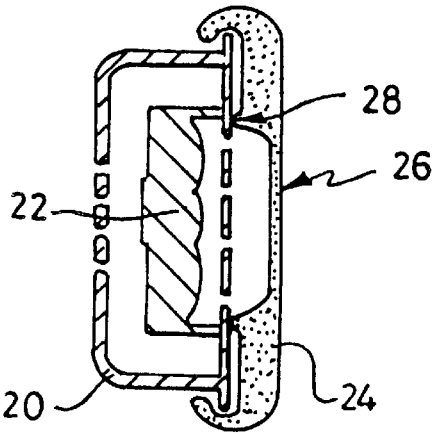
FIG. 5 illustrates an earphone for a headset, in accordance with a first embodiment of the present invention.

A preferred example of earphone for a headset is shown in FIG. 5 of the accompanying drawings; FIGS. 6 to 10 show modifications.

In FIG. 5, the earphone shell 20 supports a drive unit 22 which is covered by a cushion 24 of auxetic foam having a central portion 26 of reduced thickness of approximately the same area as the drive unit. The cushion 24 is fixed to the shell 20 at the perimeter of the drive unit, as indicated at 28, so as to minimise increase in acoustic gain and thus improve stability margins and noise cancellation performance, as previously stated.

Figure 6:
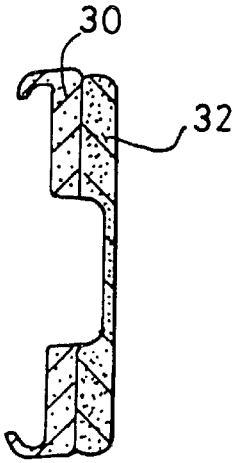
FIG. 6 illustrates an earphone for a headset, in accordance with a second embodiment of the present invention.

FIG. 6 shows a modification. Thus, the property of the auxetic foam 30 to decrease in acoustic impedance when compressed can also be used with advantage in combination with an ear-contact layer 32 of conventional foam. With this combination of foam materials, the change in acoustic impedance with applied pressure can be reduced due to the properties of the normal foam counteracting those of the auxetic foam. The performance of the earphone, and headset incorporating a coupled pair of such earphones, can therefore be arranged to have a more consistent response to changes in applied pressure.

Figure 7:
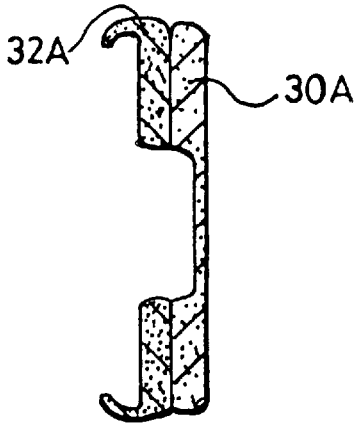
FIG. 7 illustrates an earphone for a headset, in accordance with a third embodiment of the present invention.

FIG. 7 shows another modification in which the auxetic foam layer 30A is again combined with a layer 32A of conventional foam, but in this case the auxetic foam layer 30A is the ear contact layer, thus in use giving better moulding to the ear as well as improved acoustic performance.

In the embodiments of FIGS. 6 and 7, either the auxetic foam layer or the conventional foam layer or both may be impregnated with liquid, typically a light oil, also to improve acoustic performance. In such a case, the impregnated layer or layers require to be encased in an impervious skin or cover, for example of plastics sheet or leatherette.

Figure 8:
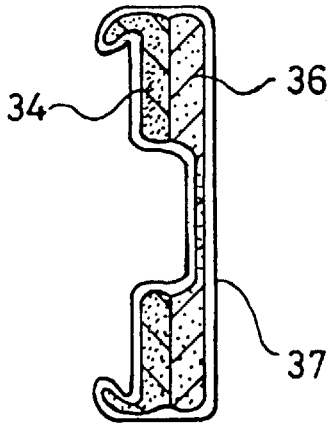
FIG. 8 illustrates an earphone for a headset, in accordance with a fourth embodiment of the present invention.

FIG. 8 shows a further modification wherein the auxetic foam layer is used in combination with a skin encased liquid layer, as an alternative way of improving acoustic properties. In FIG. 8, the skin or cover encased liquid layer is referenced 34 and the auxetic foam layer is referenced 36. The complete cushion is encased in a cover 37. Less desirably, the liquid layer could be the ear contact layer.

Figure 9:
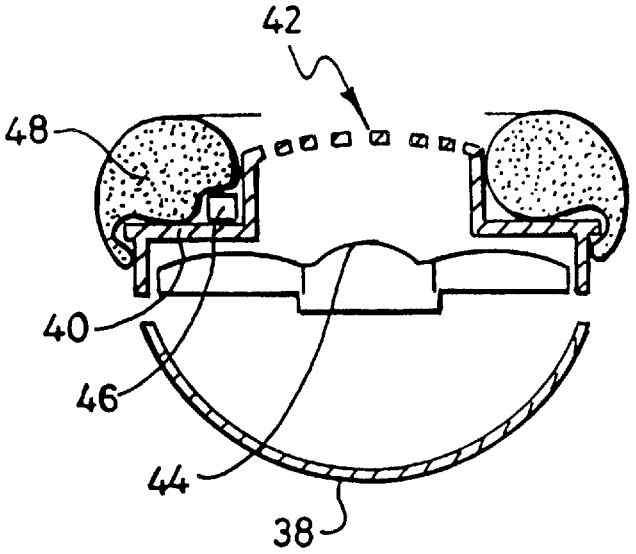
FIG. 9 illustrates the application of an auxetic foam cushion to an earphone in accordance with an aspect of the present invention.

FIG. 9 shows the application of the auxetic foam cushion to an earphone having means in the form of a baffle plate dome for limiting compression of the cushion when the earphone is pressed against the ear. The illustration shows an active headphone having a shell 38, baffle plate 40 with domed projection 42, drive unit 44, sensing microphone 46 and auxetic foam cushion 48. Any of the embodiments and modifications described with reference to FIGS. 5 to 8 could equally be applied to the earphone of FIG. 9.

Figure 10:
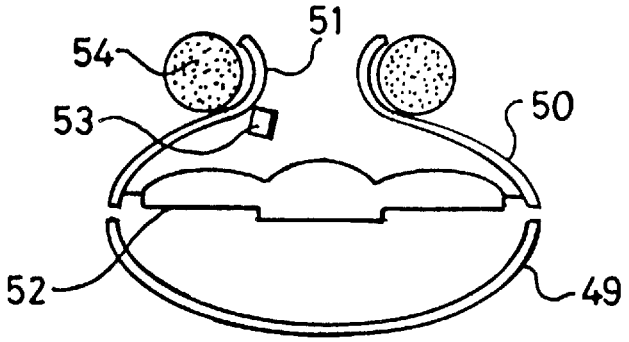
FIG. 10 illustrates the application of an auxetic foam cushion to an earphone in accordance with another aspect of the present invention.

FIG. 10 shows the application of the auxetic foam cushion to an earbud type earphone, in which the cushion is designed to seal around the entrance to the ear canal. The illustration shows an active earbud having a shell 49, front piece 50 with port 51, drive unit 52, sensing microphone 53 and auxetic foam cushion 54. Again, any of the embodiments and modifications described with reference to FIGS. 5 to 8 could equally be applied to the earphone of FIG. 10.

What is claimed is:

1. An earphone having active noise cancellation, including a sound drive unit and a deformable earpad, wherein at least part of the earpad which is compressible is made of auxetic foam characterized as contracting in directions perpendicular to an applied compression to reduce overall volume.

2. An earphone according to claim 1, including an earphone shell carrying a baffle plate with an opening over the drive unit and between the drive unit and the earpad, the earpad being of reduced thickness in a central region having an area approximately correponding to that of the baffle plate opening.

3. An earphone according to claim 2, wherein the central region of reduced thickness is spaced from the baffle plate so that an outer surface of the earpad remote from the baffle plate is approximately planar.

4. An earphone according to claim 2, wherein the earpad is fixed to the baffle plate around the said opening.

5. An earphone according to claim 4, wherein the earpad is inserted into a separately formed skin cover.

6. An earphone according to claim 1, wherein the earpad has multiple layers, including an auxetic foam layer and a supplementary layer of liquid, liquid/foam or conventional foam.

7. An earphone according to claim 6, wherein the auxetic foam layer is an inner layer and the supplementary layer is the ear-contact layer.

8. An earphone according to claim 7, wherein the inner auxetic foam layer is an annular layer.

9. An earphone according to claim 8, wherein the inner annular layer surrounds the area defined by the central region of reduced thickness, which is formed in the supplementary layer.

10. An earphone according to claim 6, wherein the conventional foam layer is an inner layer and the auxetic foam layer is the ear-contact layer.

11. An earphone according to claim 10, wherein the inner conventional foam layer is an annular layer.

12. An earphone according to claim 11, wherein the annular layer surrounds the area defined by the central region of reduced thickness, which is formed in the auxetic foam layer.

13. An earphone according to claim 1, wherein the earpad includes a skin covering.

14. An earphone according to claim 13, wherein the auxetic foam is moulded with an integral skin.

15. An earphone according to claim 13, wherein the earpad is inserted into a separately formed skin cover.

16. An earphone according to claim 1, including means for limiting compression of the cushion when the earphone is pressed against the ear.

17. An earphone according to claim 16, in which the compression limiting means comprises a central projection on a baffle plate.

18. An earphone according to any of claims 1 to 17, in the form of an ear defender.

19. An earphone according to any of claims 1 to 17, in the form of an earphone for an active headset.

20. An earphone according to any of claims 1 to 17, in the form of a supra-aural earphone.

21. An earphone according to any of claims 1 to 17, in the form of an earbud-type earphone.

22. An earphone according to claim 1, wherein the earpad is inserted into a separately formed skin cover.

23. A headset comprising:

a first earphone having active noise cancellation, including a first sound drive unit and a first deformable earpad, wherein at least part of the first deformable earpad which is compressible is made of auxetic foam characterized as contracting in directions perpendicular to an applied compression to reduce overall volume; and a second earphone coupled to the first earphone having active noise cancellation, including a second sound drive unit and a second deformable earpad, wherein at least part of the second deformable earpad which is compressible is made of auxetic foam characterized as contracting in directions perpendicular to an applied compression to reduce overall volume.

* * * * *